US005485966A

United States Patent [19]

Cradeur

[11] Patent Number: 5,485,966

[45] Date of Patent: Jan. 23, 1996

[54] REMOTELY CONTROLLED CHOPPING MACHINE FOR TANK CLEANING

[75] Inventor: Robert R. Cradeur, Sulphur, La.

[73] Assignee: Serv-Tech, Inc., Houston, Tex.

[21] Appl. No.: 237,455

[22] Filed: May 3, 1994

[51] Int. Cl.[6] ..... B02C 13/02; B02C 25/00

[52] U.S. Cl. ..... 241/39; 241/101.72; 241/101.74; 241/189.1

[58] Field of Search ..... 134/168 R, 181; 180/6.2; 239/227, 722; 241/38, 39, 101.72, 101.74, 189.1, 282.1, 282.2, 277; 299/1.5, 30, 25, 39, 89, 91; 901/1

[56] References Cited

U.S. PATENT DOCUMENTS

| | | | |
|---|---|---|---|
| 2,197,549 | 4/1940 | Hargrave et al. | 241/101.7 X |
| 2,336,487 | 12/1943 | Lewis et al. | 299/39 |
| 2,341,486 | 2/1944 | Swertfeger | 241/101.7 X |
| 3,560,050 | 2/1971 | Lockwood | 299/39 |
| 3,907,366 | 9/1975 | Pender | 299/30 X |
| 3,937,261 | 2/1976 | Blum | 241/277 X |
| 4,023,862 | 5/1977 | Gold | 299/30 X |
| 4,192,551 | 3/1980 | Weimer et al. | 299/30 X |
| 4,376,515 | 3/1983 | Søe | 241/277 X |
| 4,753,484 | 6/1988 | Stolarzyk et al. | 299/30 X |
| 4,817,653 | 4/1989 | Krajicek et al. | 239/722 X |

*Primary Examiner*—Timothy V. Eley
*Attorney, Agent, or Firm*—John R. Kirk, Jr.; Jenkens & Gilchrist

[57] ABSTRACT

A chopping machine comprises a frame and a plurality of detachable components which may be individually insertable through an entryway into a storage tank to be cleaned. The detachable components include traction drive belts and a chopping assembly. Hydraulic power means are provided exteriorly of the tank, and are connected by lines extending through the entryway to the frame mounted operating components inside the tanks. The chopping assembly comprises a plurality of replaceable blades radially disposed about a rotatable tubular member.

15 Claims, 2 Drawing Sheets

REMOTELY CONTROLLED CHOPPING MACHINE FOR TANK CLEANING

BACKGROUND OF THE INVENTION

1. Field of the Invention

This invention relates to a mobile cleaning device. More particularly, this invention relates to a remote controlled chopping machine for cutting and chopping solids buildup on the interior floor of hydrocarbon storage tanks of the type used in petroleum refineries and chemical plants.

2. Brief Description of the Related Art

Petroleum refineries, chemical plants, petroleum and chemical stock farms, and similar plants, are normally provided with large cylindrical storage tanks having diameters of from about 20 to about 300 feet and heights of from about 50 to about 100 feet and closed to the atmosphere by floating or fixed roofs. With the passage of time, and particularly when the tanks are used to store crude oil, sedimentation and fouling of the tank surfaces will occur.

Conventionally, a gang of workmen enter the tank through an entryway adjacent the bottom of the tank and manually operate high pressure hoses, similar to the hoses used in fighting fires, in order to wash down the inside of the tank. Suction lines disposed on the bottom of the tank are used to remove the wash water and sediments collected by the water. It is generally necessary for the workmen to use respirators and wear protective garments. As a consequence, a workman can work inside the tank for only a very limited time because of the debilitating working conditions, and must then leave the tank to rest.

U.S. Pat. No. 4,817,653, issued Apr. 4, 1989 to Richard W. Krajicek et al, and assigned to the assignee of the present invention, is directed to solving the problems associated with washing down the inside of the above described tanks. The '653 patent describes an essentially self-contained mobile water washing robot which is remotely operable, thereby negating the need for operating personnel to be in close proximity of the cleaning nozzles and other high pressure lines during water wash cleaning operations. U.S. Pat. No. 4,817,653 is incorporated herein by reference for all respects and purposes.

However, even with the improvements in tank cleaning disclosed in the '653 patent, the problem of solids buildup on the floor of the storage tank still exists. This is a particular problem when solids such as coke, sludge, or granite accumulate and harden over a period of time. In general, these sludge-like materials form mounds or large cakes on the bottom surface of the tank, especially in areas where there is little or no turbulence, and must be broken into smaller pieces for disposal. Heretofore, these materials were cut by laborers into fragments by repeated strokes with a pickax, and then shoveled or otherwise "mucked out". Thus, while the disclosure of '653 patent eliminated much of the dangerous, undesirable in-tank labor, improvements still need to be made. It is an object of the present invention to provide a hydraulically powered, remotely controlled, movable chopping device for breaking up the high-solids material deposits on the bottom of the above described types of hydrocarbon storage tanks.

Accordingly, the present invention is directed to an apparatus for chopping waste, such as sludge formed on the bottom of the interior of oil storage tanks, and comprises modular components that can be separately moved inside a storage tank and then conveniently assembled inside the tank to form a workable apparatus.

SUMMARY OF THE INVENTION

According to one embodiment of the present invention, an apparatus for chopping waste has a frame, a traction drive means detachably mounted on the frame, and a chopping assembly also detachably mounted on the frame. The apparatus also includes hydraulic power means for independently powering the traction means and the chopping assembly, and control means for regulating the operation of the power means. Optionally, the apparatus also includes a hydraulically powered fluid wash means that is detachably mounted on the frame of the apparatus.

DETAILED DESCRIPTION OF THE INVENTION

Figure 1:
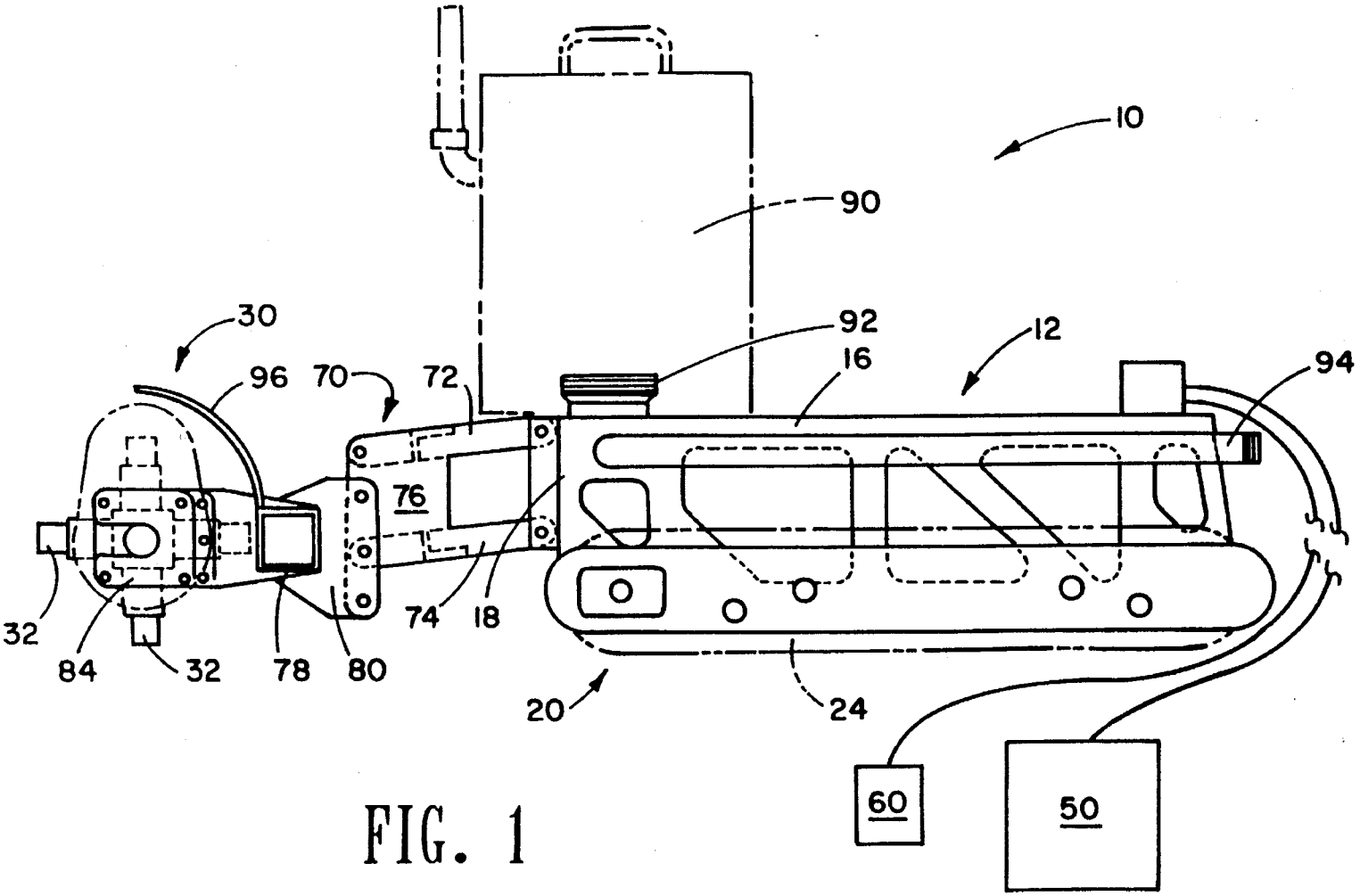
FIG. 1 is a side view of an apparatus for chopping waste having a chopping assembly detachably mounted on a forward end of the apparatus, and embodying the present invention.

In accordance with the present invention, a mobile, remotely controlled, hydraulically powered chopping machine 10 for chopping waste is provided which can be disassembled, moved into or positioned in a storage tank to be cleaned through an entryway adjacent the bottom of the tank, and then reassembled inside the tank.

The principal components of the chopping machine 10 include a frame 12, preferably having an open bottom configuration, to which a hydraulically powered and controlled traction drive means 20 for moving the apparatus is detachably mounted. A hydraulically powered and controlled chopping assembly 30 is also detachably mounted on the frame 12. A hydraulic power means 50 for independently powering the traction drive means 20 and the chopping assembly 30 and a hydraulic control means 60 for regulating the operation of the hydraulic power means 50 are remotely positioned from the frame 12, preferably outside of the tank in which the main structure of the chopping machine 10 is operating. When remotely disposed in this manner, the hydraulic power means 50 is hydraulically connected through an entryway into the tank with a first hydraulic motor means 25 driving the traction drive means 20, and a second hydraulic motor means 40 driving the chopping assembly 30.

The frame 12, the traction drive means 20, the hydraulic power means 50 and hydraulic control means 60, are described in detail in the U.S. Pat. No. 4,817,653 which, as noted above, is incorporated herein for all purposes. More specifically, for the sake of brevity and avoidance of unnecessary repetition, a detailed discussion of the above identified common elements is not repeated in the description of the present invention. The traction drive means 20 of the chopping machine 10 is identified in the '653 patent as "robot articulation means 700". The remaining common elements are generally identified by the same descriptive terminology in both specifications.

Briefly, the traction drive means 20 includes a pair of detachably mounted endless belts 22,24, such as a rubber belt or a plurality of track links connected together to form an endless chain. The endless belts 22,24 are driven by the first hydraulic motor means 25 which includes a pair of hydraulic motors 26,28, one motor of the pair being operatively connected to a respective one of the endless belts 22,24.

In the preferred embodiment of the present invention, the chopping assembly 30 comprises a plurality of chopping blades 32 mounted through slots provided in a long square tube 34. Stub rotor shafts 36,38 are attached, respectively, to the left and right hand ends of the square tube 34, as viewed in FIG. 2, and are rotatably supported by a pair of bearing assemblies 42,44. The right hand stub rotor shaft 38 extends through its supporting bearing assembly 44 and engages the second hydraulic motor means 40. The second hydraulic motor means includes a hydraulic motor 46 and, preferably, is operatively connected with the rotor shaft 38 through a reduction gear box 48. Alternatively, the square tube 34 carrying the chopping blades 32 could be a cylindrical pipe having a plurality of chopping blades or cutting plates emanating from different surface portions of the pipe and arranged to cut or chop the solids buildup on the bottom of the tank.

The rotational speed of the square tube 34 carrying the chopping blades 32 must be in a range suitable for effectively processing the waste material. Furthermore, it is desirable that the waste material be subjected to at least one of chopping, mixing, scraping, stirring, cutting, pulverizing, agitating, disintegrating, digging, pounding or other similar actions. In the preferred embodiment of the present invention, the second hydraulic motor means 40 is capable of varying the rotational speed of the square tube 34 from 0 up to about 200 rpm, preferably about 120 rpm, and is designed to rotate in a clockwise direction as viewed from the right hand end of the square tube 34 in FIG. 2.

Figure 3:
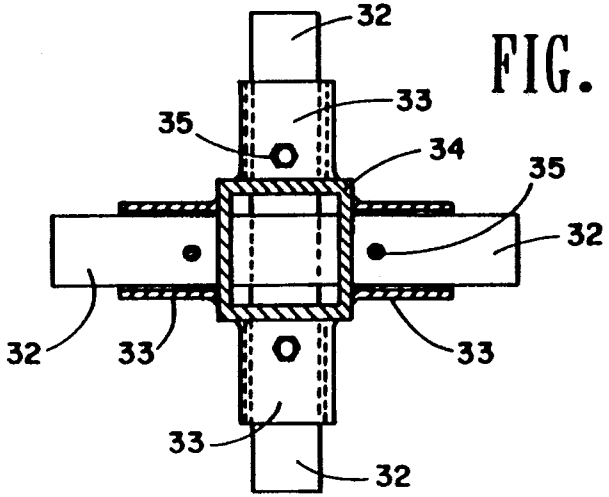
FIG. 3 is a cross sectional view of a portion of the chopping assembly, taken along the line 3—3 in FIG. 2, showing a cutting blade mounting arrangement for the apparatus embodying the present invention.

Preferably, as best shown in FIG. 3, the chopping blades 32 are mounted in a protective sleeve 33 to protect blades from becoming bent or distorted. Also, it is desirable that the chopping blades 32 be formed of a non-ferritic material such as brass, bronze, or aluminum to decrease the risk of generating sparks that could ignite volatile hydrocarbon fumes that may be present in the tank being cleaned.

Figure 2:
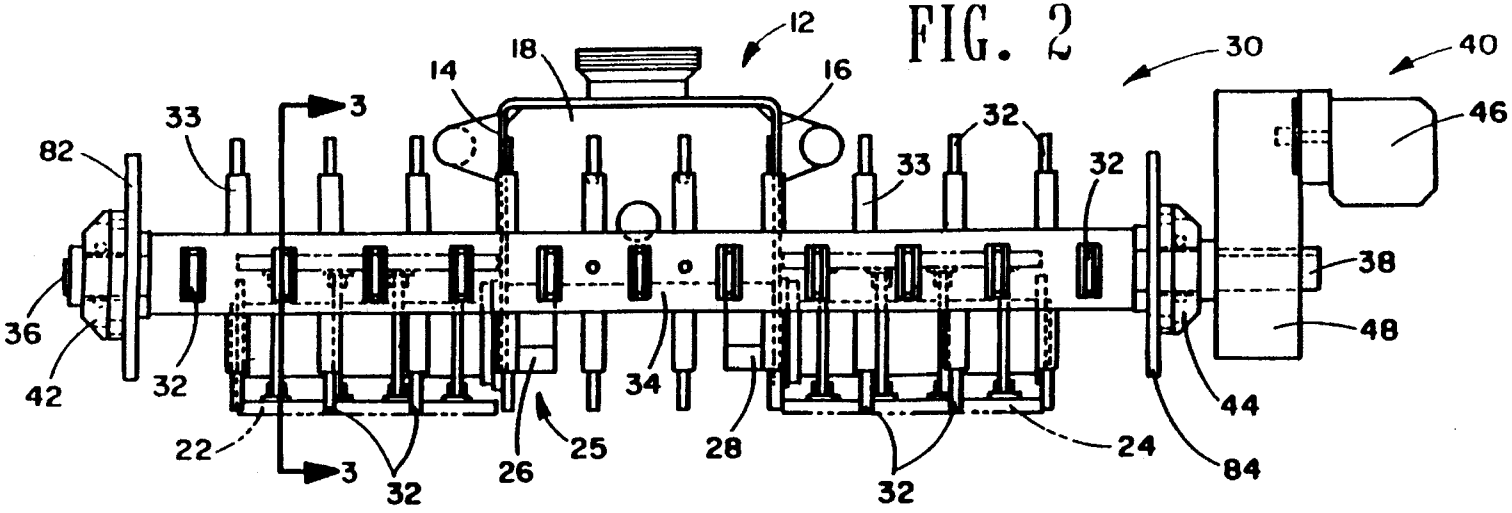
FIG. 2 is a front view of the chopping assembly component of the apparatus embodying the present invention.

As shown in FIGS. 2 and 3, the chopping blades are proportionally spaced, in a radially staggered relationship at right angles to an adjacent blade, along the square tube 34 which in the illustrated embodiment supports twenty-one chopping blades 32. In this arrangement, ten of the chopping blades 32 extend through aligned openings provided in two parallel sides of the square tube 34 and eleven of the chopping blades 32 extend through aligned openings in the remaining parallel sides of the square tube 34. The sleeves 33 are welded to the square tube 34, and centered over the openings so that the chopping blades 32 can be inserted through the openings and retained in place by bolts 35 extending through each of the sleeve 33 and an associated chopping blade 32 positioned in the sleeve. Thus, two pairs of bolts and nuts hold each chopping blades 32 within sleeve 33 on both sides of the square tube 34. By this arrangement, the chopping blades 32 are easily removed when they become worn from repeated use. Moreover, chopping blades 32 of different lengths can be easily interchanged to vary the distance from the tip of the blade to the deck of the storage tank. In the preferred embodiment, the chopping blades 32 are fourteen inches in length ½ inch thick, and two inches wide. If desired, the chopping blades 32 could have a different configuration or shape, or be adorned with a variety of notches or cutting aids to facilitate the chopping process.

The chopping assembly 30 is supported, in a fixed relationship with the frame 12, by a support assembly 70 detachably mounted on the forward end of the frame. The support assembly 70 comprises a pair of upper and lower reinforced arms 72,74 that are connected together at one end by a plate member 76 extending between the upper and lower arms, and at the other end to the frame 12. A square tubular cross member 78 is rigidly attached to the plate member 76, by a pair of connecting plate member 80, in a perpendicular relationship with the front panel 18 and side panels 14,16 of the frame 12. The tubular cross member 78 has a length substantially equal to the distance between the left and right hand bearing assemblies 42,44. A pair of flange mounting plates 82,84 are fixedly attached, such as by welding, to each end of the connecting plate member 80. Each of the flange mounting plates 82,84 contains holes therethrough for receiving bolts for attachment of the plates to the flange of a respective one of the bearing assemblies 42,44.

As shown in FIG. 2, the second hydraulic motor means 40 for operating the chopper assembly 30, is also supported by the flange mounting plate 84, by way of attachment through the housing of the right bearing assembly 44.

A protective cover, or shroud, 96 is also mounted, preferably with removable bolts, to a forwardly disposed surface of the cross member 78. Preferably, the shroud 96 extends along the length of the square tube 34 on which the chopping blades 32 are mounted from an area directly above the square tube 34 to an area directly to the rear of the chopping blades 32, i.e., between the chopping assembly 30 and the frame 12.

In an alternative embodiment of the present invention, an articulatable water jet washer 90, indicated by broken lines in FIG. 1 and described in detail in the previously incorporated U.S. Pat. No. 4,817,653, may be mounted on the frame 12. For this purpose, a threaded coupling 92 and a water supply pipe 94 are provided, respectively, on the top and sides of the frame 12. When connected with a high pressure water pump and hose as taught in the patent, an operator is able to remotely operate the water jet washer and progressively wash down the sides of the tank with high pressure water. Thus, when combined with the chopper assembly described above, an operator has the ability to chop solid waste material from the floor of a tank to be cleaned and wash down the interior walls of the tank with a single apparatus, either simultaneously or sequentially.

When a storage tank is to be cleaned, the portable hydraulic power means 50 is moved to a location adjacent the tank and individual components, i.e., the traction drive means 20, the chopping assembly 30, the second hydraulic motor means 40, and the support assembly 70 either as a unit or as two or more subassemblies, are then moved into the tank through an entryway. Also, if desired, the water jet washer 90 can also be separately moved into the tank. Next, the scaffolding and the slide rail and winch assemblies, described in the incorporated U.S. Pat. No. 4,817,653, are put in place and used to lift, move and lower the frame 12 onto the floor of the storage tank for assembly with the aforementioned individual components. After assembly, hydraulic lines between the hydraulic power means 50 and the hydraulic motors 26,28, and between the hydraulic power means 50 and the hydraulic motor 46 driving the chopping assembly 30, are then connected. Also, appropriate control lines between the hydraulic control means 60 and the respective motors are also connected. The hydraulic control means may be either positioned inside or outside the tank to be cleaned. Preferably, an operator is able to operate the appropriate control switches on the control panel from the entryway, with both the operator and control panel being positioned outside the tank. If this is not possible, the control means may be placed inside the tank and the operator fitted with protective garments and possibly, auxiliary breathing apparatus.

The remotely controlled chopping machine 10 embodying the present invention can be moved from place to place about the tank by actuation of the hydraulic motors 26,28. Both endless belts 22,24 can be driven in the same direction in order to move the frame 12 in a forward or reverse direction. The chopping machine 10 can be turned to the right or to the left in essentially a zero radius by operating one of the belts, e.g., 22, in a forward direction and the other belt, e.g., 24, in a rearward direction.

When the tank cleaning operation is complete, the hydraulic and water supply lines are disconnected and withdrawn through the entryway, the chopping machine 10 is disassembled into its component parts, and the component parts are removed from the tank by way of the entryway.

The above embodiments are given by way of example of the present invention and are not intended as limitations as further embodiments and advances will occur to those of skill in the art who practice the present invention.

What is claimed is:

1. An apparatus useful for chopping waste on the interior bottom of a storage tank having an entryway adjacent said bottom, comprising:

a frame;

a traction drive means for moving said apparatus, said traction drive means being detachably mounted on said frame;

a support assembly detachably mounted to a forward end of said frame and having a pair of upper and lower arms detachably connected to said frame at a first end of said arms, a plate member fixedly connected to a second end of said arms, and a pair of spaced apart flange mounting plates each fixedly attached to said plate member;

a chopping assembly rotatably mounted in a pair of bearing assemblies, said bearing assemblies being detachably connectable to a respective one of said flange mounting plates of the support assembly, and said chopping assembly being separately insertable through said entryway;

a hydraulic power means for independently powering said traction drive means and said chopping assembly; and, a hydraulic power means for regulating the operation of said hydraulic power means.

2. The apparatus as set forth in claim 1 wherein said chopping assembly comprises a plurality of chopping blades, said blades extending radially outwardly from a shaft member that is rotatable about a horizontal axis.

3. The apparatus, as set forth in claim 2 wherein said chopping assembly includes a mounting means attached to said frame, said shaft member being rotatably mounted on said mounting means, and said shaft member has a plurality of sleeves radially attached to said shaft member, each of said chopping blades being mounted on a respective one of said sleeves and extending radially outwardly from said sleeve.

4. The apparatus, as set forth in claim 3 wherein said sleeves are mounted along four rows equiangularly spaced around said shaft member.

5. The apparatus, as set forth in claim 4 wherein adjacent rows of said sleeves are staggered.

6. The apparatus as set forth in claim 3 wherein said apparatus includes a shroud mounted on said mounting means, said shroud being disposed about a portion of said chopping assembly extending from a first area vertically above said chopping assembly to a second area between said chopping assembly and said frame.

7. The apparatus as set forth in claim 1 wherein said frame includes a pair of spaced side members and said traction drive means includes a pair of endless belts, one of said endless belts being detachably mounted to a respective one of said side members.

8. The apparatus as set forth in claim 1 wherein said apparatus includes a fluid washing means for controllably delivering a pressurized jet of fluid.

9. An apparatus for chopping waste on the interior bottom of a storage tank having an entryway adjacent said bottom, comprising:

a frame;

a traction drive means for moving said apparatus, said traction drive mean being detachable mounted on said frame;

a support assembly detachably mounted to a forward end of said frame and having a pair of upper and lower arms detachably connected to said frame at a first end of said arms, a plate member fixedly connected to a second end of said arms, and a pair of spaced apart flange mounting plates each fixedly attached to said plate member;

a chopping assembly rotatably mounted in a pair of bearing assemblies, said bearing assemblies being detachably connectable to a respective one of said flange mounting plates of the support assembly, and said chopping assembly being separately insertable through said entryway;

a first hydraulic motor mounted on said frame and operatively connected with said traction drive means;

a first hydraulic motor control means, connected with said first hydraulic motor, for remotely regulating operation of said traction drive means;

a second hydraulic motor mounted on said chopping assembly and operatively connected with said chopping assembly;

a second hydraulic motor control means, connected with said second hydraulic motor, for remotely regulating operation of said chopping assembly; and, a hydraulic power means for delivering a flow of hydraulic fluid under pressure to said first and said second hydraulic motors, said hydraulic power means being disposed at a position remote from said frame.

10. The apparatus as set forth in claim 9 wherein said frame includes a pair of spaced side members and said traction drive means includes a pair of endless belts, one of said endless belts being detachably mounted to a respective one of said side members.

11. The apparatus as set forth in claim 9 wherein said apparatus includes a fluid washing means for controllably delivering a pressurized jet of fluid.

12. An externally powered and remotely controllable chopping apparatus for chopping sludge on the interior bottom of an oil storage tank, said storage tank having an entryway adjacent the bottom thereof, said chopping apparatus comprising:

a frame that is movable through said entryway;

a traction drive means for moving said apparatus about the interior bottom of said tank, said traction drive means being detachably mountable on said frame;

a support assembly detachably mounted to a forward end of said frame and having a pair of upper and lower arms detachably connected to said frame at a first end of said arms, a plate member fixedly connected to a second end of said arms, and a pair of spaced apart flange mounting plates each fixedly attached to said plate member;

a support assembly detachably mounted to a forward end of said frame and having a pair of upper and lower arms fixedly connected together at one end by a plate member and detachably connected to said frame at the other end, and a pair of spaced apart flange mounting plates each fixedly attached to said plate member;

a chopping assembly rotatably mounted in a pair of bearing assemblies, said bearing assemblies being detachably connectable to a respective one of said flange mounting plates of the support assembly, and said chopping assembly being separately insertable through said entryway;

a first hydraulic motor mounted on said frame and operatively connected with said traction drive means;

a first hydraulic motor control means, connected with said first hydraulic motor, for remotely regulating operation of said traction drive means;

a second hydraulic motor mounted on and operatively connected with said chopper assembly;

a second hydraulic motor control means, connected with said second hydraulic motor, for remotely regulating operation of said chopper assembly; and, a hydraulic power means for delivering a flow of hydraulic fluid under pressure to said first and said second hydraulic motors, said hydraulic power means being disposed at a position remote from said frame.

13. The apparatus as set forth in claim 12 wherein said chopping apparatus includes a fluid washing means for controllably delivering a pressurized jet of fluid, said fluid washing means being detachably mounted on said frame.

14. The apparatus as set forth in claim 12 wherein said frame includes a pair of spaced side members and said traction drive means includes a pair of endless belts, one of said endless belts being detachably mounted to a respective one of said side members.

15. An externally powered and remotely controllable chopping apparatus for chopping sludge on the interior bottom of an oil storage tank, said storage tank having an entryway adjacent the bottom thereof, said chopping apparatus comprising:

an open-bottomed frame having opposed side panels and a top panel interconnecting said side panels, said frame having a height and width such that the frame can be moved into the storage tank through said entryway;

a pair of endless belts each being detachably mountable on one of said opposed side panels of the frame and separately insertable through said entryway;

a support assembly detachably mounted to a forward end of said frame and having a pair of upper and lower arms fixedly connected together at one end by a late member and detachably connected to said frame at the other end, and a pair of spaced apart flange mounting plates each fixedly attached to said plate member;

a chopping assembly rotatably mounted in a pair of bearing assemblies, said bearing assemblies being detachably connectable to a respective one of said flange mounting plates of the support assembly, and said chopping assembly being separately insertable through said entryway;

a first hydraulic motor mounted on said frame and operatively connected with said pair of endless belts;

a first hydraulic motor control means, connected with said first hydraulic motor, for remotely regulating operation of said pair of endless belts;

a second hydraulic motor mounted on and operatively connected with said chopper assembly;

a second hydraulic motor control means, connected with said second hydraulic motor, for remotely regulating operation of said chopper assembly; and a hydraulic power means for delivering a flow of hydraulic fluid under pressure to said first and said second hydraulic motors, said hydraulic power means being disposed at a position outside of said tank and hydraulically connected through the entryway with said first and second hydraulic motors.

* * * * *